US005447968A

United States Patent [19]

Barnett et al.

[11] Patent Number: 5,447,968

[45] Date of Patent: Sep. 5, 1995

[54] POLYURETHANE-FORMING BINDER SYSTEMS CONTAINING 2,2'-DIPYRIDYL, 1,10-PHENANTHROLINE, AND THEIR SUBSTITUTED ALKYL DERIVATIVES

[75] Inventors: Kenneth W. Barnett, Worthington; William G. Carpenter, Powell; William R. Dunnavant, Columbus; Robert B. Fechter, Worthington, all of Ohio

[73] Assignee: Ashland Inc., Columbus, Ohio

[21] Appl. No.: 95,583

[22] Filed: Jul. 23, 1993

[51] Int. Cl.[6] ..... B22C 1/22

[52] U.S. Cl. ..... 523/142; 523/143; 524/508; 524/509; 528/65; 528/85

[58] Field of Search ..... 523/142, 143; 524/508, 524/509; 528/65, 85

[56] References Cited

U.S. PATENT DOCUMENTS

| | | | |
|---|---|---|---|
| 3,409,579 | 11/1968 | Robins | 523/143 |
| 3,485,797 | 12/1969 | Robins | 526/71 |
| 4,268,425 | 5/1981 | Gardikes | 523/143 |
| 4,692,479 | 9/1987 | Schneider et al. | 523/209 |
| 4,724,892 | 2/1988 | Schneider et al. | 164/137 |

*Primary Examiner*—Paul R. Michl
*Assistant Examiner*—John J. Guarriello
*Attorney, Agent, or Firm*—David L. Hedden

[57] ABSTRACT

This invention relates to polyurethane-forming foundry binder systems which contain a nitrogen-containing aromatic compound selected from the group consisting of 2,2'-dipyridyl, 1,10-phenanthroline, and their substituted alkyl derivatives. The foundry binder systems are particularly useful for making foundry mixes used in the cold-box fabrication process for making foundry shapes. However, the binders systems can also be used to hold foundry shapes, such as molds and cores, together in an assembly.

20 Claims, No Drawings

POLYURETHANE-FORMING BINDER SYSTEMS CONTAINING 2,2'-DIPYRIDYL, 1,10-PHENANTHROLINE, AND THEIR SUBSTITUTED ALKYL DERIVATIVES

TECHNICAL FIELD

This invention relates to polyurethane-forming foundry binder systems which contain a nitrogen-containing aromatic compound selected from the group consisting of 2,2'-dipyridyl, 1,10,-phenanthroline, and their substituted alkyl derivatives. The foundry binder systems are used to prepare foundry mixes and foundry shapes made from the foundry mixes by the cold-box process. The addition of the 2,2'-dipyridyl, 1,10,-phenanthroline, and their substituted alkyl derivatives to the polyurethane-forming foundry binder systems improves the bench life of the foundry mix. The foundry binders can also be used as adhesives to hold foundry shapes together, such as cores and molds, in an assembly.

BACKGROUND OF THE INVENTION

Polyurethane binders are often used in the foundry industry to hold shaped foundry aggregate together as a mold or core. See for example U.S. Pat. Nos. 3,409,579 and 3,676,392. They are also used as adhesives to hold foundry molds and cores together in an assembly. See for example U.S. Pat. Nos. 4,692,479 and 4,724,892 which describe such foundry pastes.

One of the major processes used in the foundry industry for making metal parts is sand casting. In sand casting, disposable foundry shapes (usually characterized as molds and cores) are made by shaping and curing a foundry mix which is a mixture of sand and an organic or inorganic binder. The binder is used to strengthen the molds and cores.

One of the processes used in sand casting for making molds and cores is the cold-box process. In this process a gaseous curing agent is passed through a compacted shaped mix to produce a cured mold and/or core.

A polyurethane-forming binder system commonly used in the cold-box process is cured with a gaseous tertiary amine catalyst. The polyurethane-forming binder system usually consists of a phenolic resin component and polyisocyanate component which are mixed with sand prior to compacting and curing to form a foundry mix.

When the two components of the binder system are mixed with the sand to form a foundry mix, they may prematurely react prior to curing with the gaseous catalyst. If this reaction occurs, it will reduce the flowability of the foundry mix when it is used for making molds and cores, and the resulting molds and cores will have reduced strengths.

The bench life of the foundry mix is the time interval between forming the foundry mix and the time when the foundry mix is no longer useful for making acceptable molds and cores. A measure of the usefulness of the foundry mix and the acceptability of the molds and cores prepared with the foundry mix is the tensile strength of the molds and cores. If a foundry mix is used after the bench life has expired, the resulting molds and cores will have unacceptable tensile strengths.

Because it is not always possible to use the foundry mix immediately after mixing, it is desirable to prepare foundry mixes with an extended bench life. Many patents have described compounds which improve the bench life of the foundry mix. Among the compounds useful to extend the bench life of the foundry mix are organic and/or inorganic phosphorus containing compounds.

Examples of organic phosphorus-containing compounds used as benchlife extenders with polyurethane-forming binder systems are disclosed in U.S. Pat. No. 4,436,881 which discloses certain organic phosphorus containing compounds such as dichloroarylphosphine, chlorodiarylphosphine, arylphosphinic dichloride, or diarylphosphinyl chloride, and U.S. Pat. No. 4,683,252 which discloses organohalophosphates such as monophenyldichlorophosphate. Examples of inorganic phosphorus-containing compounds which extend the bench life of polyurethane-forming binder systems are disclosed in U.S. Pat. No. 4,540,724 which discloses inorganic phosphorus halides such as phosphorus oxychloride, phosphorus trichloride, and phosphorus pentachloride, and U.S. Pat. No. 4,602,069 which discloses inorganic phosphorus acids such as orthophosphoric acid, phosphoric acid, hypophosphoric acid, metaphosphoric acid, pyrophosphoric acid, and polyphosphoric acid.

Also see U.S. Pat. No. 4,760,101 which describes the use of certain carboxylic acids, such as citric acid, to extend the benchlife of polyurethane-forming foundry binders.

In order for a compound to be effective as a bench life extender, it first must be compatible with the polyisocyanate component of the urethane forming binder and mix well with sand. Furthermore, in addition to improving the bench life of foundry mixes made with sand having a range of temperatures normally found in foundry environments, such compounds should have low volatility to minimize inhalation by workers in the foundry. Additionally, such compounds should not create unacceptable stress to the environment.

SUMMARY OF THE INVENTION

This invention relates to polyurethane-forming foundry binder systems curable with a catalytically effective amount of an amine catalyst comprising as separate components:

(A) a phenolic resin component;

(1) a phenolic resin;

(2) an effective amount of a nitrogen-containing aromatic compound selected from the group consisting of 2,2'-dipyridyl, 1,10,-phenanthroline, and their substituted alkyl derivatives; and (B) a polyisocyanate component.

The foundry binder systems are particularly useful for making foundry mixes used in the cold-box fabrication process for making foundry shapes. However, the binder systems can also be used to hold foundry shapes, such as molds and cores, together in an assembly.

The foundry mixes are prepared by mixing components A and B with an aggregate. The foundry mixes are preferably used to make molds and cores by the cold-box process which involves curing the molds and cores with a gaseous tertiary amine. The cured molds and cores are used to cast ferrous and non ferrous metal parts.

The 2,2'-dipyridyl, 1,10,-phenanthroline, and their substituted alkyl derivatives can be used as benchlife extenders in cold-box binder systems.

BEST MODE AND OTHER MODES OF PRACTICING THE INVENTION

The phenolic resin component of the binder system comprises a phenolic resin, preferably a polybenzylic ether phenolic resin and a nitrogen-containing aromatic compound. Solvents, as specified, are also used in the phenolic resin component along with various optional ingredients such as adhesion promoters and release agents.

The polybenzylic ether phenolic resin is prepared by reacting an excess of aldehyde with a phenol in the presence of either an alkaline catalyst or a divalent metal catalyst according to methods well known in the art. The preferred polybenzylic ether phenolic resins used to form the subject binder compositions are polybenzylic ether phenolic resins which are specifically described in U.S. Pat. No. 3,485,797 which is hereby incorporated by reference into this disclosure.

These polybenzylic ether phenolic resins are the reaction products of an aldehyde with a phenol. They preferably contain a preponderance of bridges joining the phenolic nuclei of the polymer which are ortho-ortho benzylic ether bridges. They are prepared by reacting an aldehyde and a phenol in a mole ratio of aldehyde to phenol of at least 1:1, generally from 1.1:1.0 to 3.0:1.0 and preferably from 1.1:1.0 to 2.0:1.0, in the presence of a metal ion catalyst, preferably a divalent metal ion such as zinc, lead, manganese, copper, tin, magnesium, cobalt, calcium, or barium.

Generally, the phenols used to prepare the phenolic resole resins may be represented by the following structural formula:

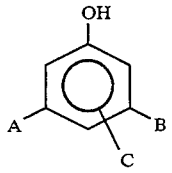

wherein A, B, and C are hydrogen atoms, or hydroxyl radicals, or hydrocarbon radicals or oxyhydrocarbon radicals, or halogen atoms, or combinations of these. However, multiple ring phenols such as bisphenol A may be used.

Specific examples of suitable phenols used to prepare the polybenzylic ether phenolic resins include phenol, o-cresol, p-cresol, p-butylphenol, p-amylphenol, p-octylphenol, and p-nonylphenol.

The aldehydes reacted with the phenol include any of the aldehydes heretofore used to prepare polybenzylic ether phenolic resins such as formaldehyde, acetaldehyde, propionaldehyde, furfuraldehyde, and benzaldehyde. In general, the aldehydes employed have the formula R'CHO wherein R' is a hydrogen or a hydrocarbon radical of 1 to 8 carbon atoms. The most preferred aldehyde is formaldehyde.

The polybenzylic ether phenolic resin is preferably non-aqueous. By "non-aqueous" is meant a polybenzylic ether phenolic resin which contains water in amounts of no more than about 10%, preferably no more than about 1% based on the weight of the resin. The polybenzylic ether phenolic resin used is preferably liquid or soluble in an organic solvent. Solubility in an organic solvent is desirable to achieve uniform distribution of the phenolic resin component on the aggregate. Mixtures of polybenzylic ether phenolic resins can be used.

Alkoxy-modified polybenzylic ether phenolic resins may also be used as the phenolic resin. These polybenzylic ether phenolic resins are prepared in essentially the same way as the unmodified polybenzylic ether phenolic resins previously described except a lower alkyl alcohol, typically methanol, is reacted with the phenol and aldehyde or reacted with an unmodified phenolic resin.

In addition to the polybenzylic ether phenolic resin, the phenolic resin component of the binder composition also contains at least one organic solvent. Preferably the amount of solvent is from 40 to 60 weight percent of total weight of the phenolic resin component. Specific solvents and solvent combinations will be discussed in conjunction with the solvents used in the polyisocyanate component.

The nitrogen-containing aromatic compound is selected from the group consisting of 2,2'-dipyridyl, 1,10,-phenanthroline, and their substituted alkyl derivatives. These compounds and their alkyl substituted derivatives are well known as is their method of synthesis. Preferably the alkyl substituted derivatives contain linear alkyl groups having from 1 to 10 carbon atoms in the alkyl group.

The nitrogen-containing aromatic compound is preferably added to the phenolic resin component of the binder, and is used in an amount effective to extend the bench life of the sand mix formed by mixing the polyurethane-forming binder system and sand. Generally, this will be in an amount of 0.005 to 1.0 weight percent, preferably 0.01 to 0.1 weight percent based upon the total weight of the binder, i.e. the phenolic resole resin component and polyisocyanate component. Naturally, greater amounts can be used, but it is not likely that additional improvements in performance will result above 0.5 weight percent.

The isocyanate component of the binder system acts as a hardener and is a polyisocyanate having a functionality of two or more, preferably 2 to 5. It may be aliphatic, cycloaliphatic, aromatic, or a hybrid polyisocyanate. Mixtures of such polyisocyanates may be used. These are formed by reacting excess polyisocyanate with compounds having two or more active hydrogen atoms, as determined by the Zerewitinoff method. Preferably the polyisocyanate component contains an acid containing compound such as an acid chloride or acid anhydride. Optional ingredients such as release agents may also be used in the isocyanate hardener component.

Representative examples of polyisocyanates which can be used are aliphatic polyisocyanates such as hexamethylene diisocyanate, alicyclic polyisocyanates such as 4,4'-dicyclohexylmethane diisocyanate, and aromatic polyisocyanates such as 2,4- and 2,6-toluene diisocyanate, diphenylmethane diisocyanate, and dimethyl derivates thereof. Other examples of suitable polyisocyanates are 1,5-naphthalene diisocyanate, triphenylmethane triisocyanate, xylylene diisocyanate, and the methyl derivates thereof, polymethylenepolyphenyl isocyanates, chlorophenylene-2,4-diisocyanate, and the like.

The polyisocyanates are used in sufficient concentrations to cause the curing of the polybenzylic ether phenolic resin when gassed with the amine curing catalyst. In general the isocyanate ratio of the polyisocyanate to the hydroxyl of the polybenzylic ether phenolic resin is from 0.75:1.25 to 1.25:0.75, preferably about 0.9:1.1 to 1.1:0.9. The polyisocyanate is used in a liquid form.

Solid or viscous polyisocyanates must be used in the form of organic solvent solutions, the solvent generally being present in a range of up to 80 percent by weight of the solution.

Acid containing compounds which are used in the polyisocyanate component include acid chlorides and acid anhydrides. Representative examples of acid chlorides which can be used include pthalolyl chloride, adipoyl chloride, sebacoyl chloride, cyanuric chloride, phenyl dichloro phosphate, and benzene phosphonic dichloride. Representative examples of acid anhydrides which can be used include maleic anhydride and chloracetic anhydride. The amount of acid containing compound used in the polyisocyanate component is generally from 0.01 to 3.0 weight percent, preferably 0.05 to 0.1 weight percent based upon the total weight of the binder.

Those skilled in the art will know how to select specific solvents for the phenolic resin component and polyisocyanate hardener component. The organic solvents which are used with the polybenzylic ether phenolic resin in the polybenzylic ether phenolic resin component are aromatic solvents, esters, ethers, and alcohols, preferably mixtures of these solvents.

It is known that the difference in the polarity between the polyisocyanate and the polybenzylic ether phenolic resins restricts the choice of solvents in which both components are compatible. Such compatibility is necessary to achieve complete reaction and curing of the binder compositions of the present invention. Polar solvents of either the protic or aprotic type are good solvents for the polybenzylic ether phenolic resin, but have limited compatibility with the polyisocyanate.

The polar solvents should not be extremely polar such as to become incompatible with the aromatic solvent. Suitable polar solvents are generally those which have been classified in the art as coupling solvents and include furfural, furfuryl alcohol, Cellosolve acetate, butyl Cellosolve, butyl Carbitol, diacetone alcohol, and Texanol. Other polar solvents include liquid dialkyl esters such as dialkyl phthalate of the type disclosed in U.S. Pat. No. 3,905,934 and other dialkyl esters such as dimethyl glutarate.

Aromatic solvents, although compatible with the polyisocyanate, are less compatible with the phenolic resins. It is, therefore, preferred to employ combinations of solvents and particularly combinations of aromatic and polar solvents. Suitable aromatic solvents are benzene, toluene, xylene, ethylbenzene, and mixtures thereof. Preferred aromatic solvents are mixed solvents that have an aromatic content of at least 90% and a boiling point range of 138° C. to 232° C.

Drying oils, for example those disclosed in U.S. Pat. No. 4,268,425, may also be used in the polyisocyanate component. Drying oils may be synthetic or natural occurring and include glycerides of fatty acids which contain two or more double bonds whereby oxygen on exposure to air can be absorbed to give peroxides which catalyze the polymerization of the unsaturated portions.

The binder system is preferably made available as a two-package system with the phenolic resin component in one package and the polyisocyanate component in the other package. Usually, the binder components are combined and then mixed with sand or a similar aggregate to form the foundry mix or the mix can be formed by sequentially mixing the components with the aggregate. Preferably the phenolic resin component is first mixed with the sand before mixing the isocyanate component with the sand. Methods of distributing the binder on the aggregate particles are well-known to those skilled in the art. The mix can, optionally, contain other ingredients such as iron oxide, ground flax fibers, wood cereals, pitch, refractory flours, and the like.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used is known to those skilled in the art. The preferred aggregate employed for preparing foundry mixes is sand wherein at least about 70 weight percent, and preferably at least about 85 weight percent, of the sand is silica. Other suitable aggregate materials for ordinary foundry shapes include zircon, olivine, aluminosilicate, chromite sands, and the like.

In ordinary sand type foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate in ordinary sand-type foundry shapes.

Although the aggregate employed is preferably dry, small amounts of moisture, generally up to about 1 weight percent based on the weight of the sand, can be tolerated. This is particularly true if the solvent employed is non-water-miscible or if an excess of the polyisocyanate necessary for curing is employed since such excess polyisocyanate will react with the water.

The foundry mix is molded into the desired shape, whereupon it can be cured. Curing can be affected by passing a tertiary amine through the molded mix such as described in U.S. Pat. No. 3,409,579 which is hereby incorporated into this disclosure by reference.

Another additive which can be added to the binder composition, usually the phenolic resin component, in order to improve humidity resistance is a silane such as those described U.S. Pat. No. 4,540,724 which is hereby incorporated into this disclosure by reference.

Foundry pastes for holding together foundry shapes in an assembly can be made according to methods well known in the art. See for example U.S. Pat. Nos. 4,692,479 and 4,724,892 which describe such foundry pastes and is hereby incorporated by reference into this disclosure. When the nitrogen-containing aromatic compound is used in a polyurethane binder system which will be used as an adhesive for holding foundry shapes together in an assembly, the amount added to the phenolic resin component is from 0.05 to 1.0 weight percent, preferably from 0.1 to 0.5 weight percent, based upon the weight of the phenolic resin in the phenolic resin component.

Both the phenolic resin component and polyisocyanate components of the foundry paste preferably contain a filler, preferably hydrophobic fumed silica which acts as a thixotropic agent. Thixotropic agents by definition impart to the mixture a variable viscosity depending on the level of the shear to which the mixture is subjected. The thixotropy of the composition may be measured by its thixotropic index which is the ratio of its low shear viscosity to its high shear viscosity.

The amount of this thixotropic agent blended with each part is sufficient to provide the resin component and the hardener component with similar viscosities.

The amount of filler in the polyisocyanate component is from about 0.5% to about 20%, preferably about 1.0% to about 10%, and more preferably about 1.5% to about 5%, relative to the weight of this component. A preferred hydrophobic filler is a hydrophobic fumed silica such as Cab-O-Sil N-70-TS available from the Cabot Corporation of Tuscola, Ill. Such fumed silicas may be made by the hydrolysis of silicon tetrachloride at about 1,100° C. so as a to produce colloidal silica particles of high purity. By "high purity" is meant that the silica is 99% by weight silicon dioxide with no measurable calcium, sodium or magnesium. The surface area of a fumed silica such as N-70-TS is about 100±20 square meters per gram.

The fumed silica is made hydrophobic by treating it with a compound capable of substantially decreasing its water adsorbance. Such compounds include organosilicone compounds such as silane. A particularly preferred silane is polydimethyl siloxane. The individual fumed silica particles have a nominal particle size in the range of about 0.007 to about 0.012 microns.

Preferably, a filler material is also employed in the resin component of the two component system. Although the preferred filler for the resin component is a hydrophobic filler of the same type as used in the polyisocyanate component, the resin filler need not be hydrophobic. Examples of other fillers acceptable for the resin component include a hydrophilic fumed silica such as M-5 available from the Cabot Corporation, bentonite clays preferably treated with a quaternary ammonium compound (such as SD-2 available from N. L. Industries of Highstown, N.J.), bis-diethylene glycol terephthalates such as Terol 250 and 250D, glyceryl tris 12-hydroxy stearate such as Thixcin E available from N. L. Industries, polysaccharides such as Aquathix available from Tenneco Chemicals Company, and certain other fillers such as Bentone 34 available from N. L. Industries and Versamide 335 available from General Mills Chemicals, Inc., of Kankakee, Ill. The amount of filler in the resin component is about 0.5% to about 25%, preferably about 0.5% to about 15%, more preferably about 1% to about 9% relative to the weight of this component.

The examples will illustrate specific embodiments of the invention. These examples along with the written description will enable one skilled in the art to practice the invention. It is contemplated that many other embodiments of the invention will be operable besides these specifically disclosed.

EXAMPLES 1–6

Comparative Example A and Examples 1 to 4 will illustrate the use of foundry binder systems to make foundry cores by the cold-box process. In all of the examples the test specimens were produced by the cold-box process by contacting the compacted mixes with triethylamine (TEA) for 1.0 second. All parts are by weight and all temperatures are in °C. unless otherwise specified. The following abbreviations are used in the examples:

BLE=benchlife extender

CTR=control

DIPY=2,2'-dipyridyl as a 10% solution in dibasic ester

PHEN=1,10-phenanthroline as a 10% solution in tetrahydrofuran

PC=pthalolyl chloride

TEA=triethylamine

The same general procedures were used in all the examples. The control experiment did not use a nitrogen-containing aromatic compound as a bench life extender.

In order to carry out control experiment A and Examples 1–4, 100 parts by weight of cold sand (Manley 1L-5W sand at a temperature of 20° C. to 25° C.) were mixed with about 0.825 part of a phenolic resin component for about two minutes. Then about 0.675 part of the polyisocyanate component was added and mixed for about two additional minutes.

The phenolic resin component used in the examples comprised (a) a polybenzylic ether phenolic resin prepared with zinc acetate dihydrate as the catalyst and modified with the addition of 0.09 mole of methanol per mole of phenol, and (b) a co-solvent mixture comprising a mixture of aromatic solvents and ester solvents such that weight ratio of aromatic solvents (HI-SOL 10 and PANASOL AN3N) to ester solvents (dibasic ester and dioctyl adipate) is 0.9:1.0, wherein the weight ratio of resin to co-solvent mixture in the phenolic resin component is 1.36:1.0. The phenolic resin component also contained a silane (A-187) in the amount of 0.6 part and a release agent (EMEREST 2380) in an amount of 0.5 part, said part based upon the total weight of the resin component.

The polyisocyanate component used in the examples comprised (a) a polymethylene polyphenyl isocyanate (MONDUR MR sold by Mobay Corporation), and (b) a mixture of an aliphatic solvent (kerosene) and aromatic solvents (PANASOL AN3N and HI-SOL 15) in a weight ratio of aliphatic to aromatic solvents of about 1:2.9, such that the weight ratio of polyisocyanate to solvent mixture is about 2.7:1.0. A bench life extender was added to the polyisocyanate component in the amount specified in Table I, where pbw (parts by weight) is based upon the total weight of the phenolic resin component and the polyisocyanate component.

The resulting foundry mixes were compacted into a dogbone shaped core box by blowing and were cured using the cold-box process as described in U.S. Pat. No. 3,409,579. In this instance, the compacted mixes were then contacted with a mixture of TEA in nitrogen at 20 psi for 1.0 second, followed by purging with nitrogen that was at 60 psi for about 6 seconds, thereby forming AFS tensile test specimens (dog bones) using the standard procedure.

Measuring the tensile strength of the dog bone shapes enables one to predict how the mixture of sand and binder will work in actual foundry operations. Lower tensile strengths for the shapes indicate that the phenolic resin and polyisocyanate reacted more extensively after mixing with the sand prior to curing.

In the examples which follow, the sand mixes were cured at zero hours bench time, after 3 hours of bench time, and after 5 hours of bench time at ambient conditions in closed containers. The tensile strengths of the samples were measured immediately and 24 hours after gassing with TEA. The results are given in Table I.

TABLE I (TENSILE STRENGTHS OF FOUNDRY SHAPES MADE WITH FOUNDRY BINDERS)

| BINDER COMPOSITION | | | TENSILE STRENGTH | | | | | |
|---|---|---|---|---|---|---|---|---|
| | | AMOUNT | 0 HR BENCH | | 3 HR. BENCH | | 5 HR. BENCH | |
| EXAMPLE | BLE | (PBW)[1] | Imm. | 24 Hr. | Imm. | 24 Hr. | Imm. | 24 Hr. |
| CTR A | — | — | 156 | 239 | 86 | 149 | 53 | 98 |
| 1 | DIPY | 0.06 | 157 | 229 | 91 | 163 | 67 | 116 |
| 2 | DIPY/PC | 0.06 | 160 | 221 | 109 | 191 | 98 | 176 |
| 3 | PHEN | 0.06 | 164 | 228 | 93 | 162 | 71 | 126 |
| 4 | PHEN/PC | 0.06 | 159 | 242 | 118 | 200 | 94 | 165 |

[1]The parts of DIPY and PHEN is based upon 100 parts of phenolic resin component. The parts of PC is based upon 100 parts of the isocyanate component.

The data in Table I indicate that DIPY and PHEN were effective bench life extenders for foundry mixes prepared with the binders tested. The data show they are particularly effective in sand which has aged three and five hours after mixing. Examples 2 and 4 show that the effect of DIPY and PHEN is further improved when PC is added to the polyisocyanate component.

EXAMPLES 5–9

Examples 5 to 9 will illustrate the use of the binder systems as adhesive pastes to hold foundry shapes together in an assembly. Adhesive pastes are prepared as set forth in Example 2 of U.S. Pat. No. 4,692,479 except zinc acetate is used to prepare the phenolic resin component and the nitrogen-containing aromatic compound is added to the phenolic resin component. Typically, lead catalysts, as shown in CTR B, are used in these foundry pastes, but there is an interest in substituting zinc for the lead catalyst. The problem is that the residual zinc catalyst in the phenolic resins is also a powerful urethane catalyst and causes more rapid cure of the phenolic polyol and the polymeric isocyanate than is desired. In addition the cure speed decreases drastically with time unless an excess of an amine catalyst like Polycat SA-1 is used and then the cure rate is faster than desired.

Gel times and set times of pastes made are shown in Table II at one hour and several days after the components had aged. (The number of days the components aged is given in parenthesis.) It can be seen that the use of a lead catalyst will provide a stable system with a desirable set time. This stable and desirable set time cannot be obtained using a zinc catalyst unless DIPY is added to complex and destroys the effect of the zinc on the reaction rate, allowing the rate of reaction to be controlled entirely by the SA-1 catalyst.

TABLE II

INFLUENCE OF ZINC ION ON THE DECREASE OF CATALYTIC ACTIVITY WITH TIME

| | | | One hour | | Age (Days) | | Age (Days) | | Age (Days) | |
|---|---|---|---|---|---|---|---|---|---|---|
| Example | SA-1, % | Comment | Gel, min. | Set, min. | Gel, min. | Set, min. | Gel, min. | Set, min. | Gel, min. | Set, min. |
| CTR B | 0.05 | Pb based resin | 6.7 | 10.5 | 8.3(5) | 13.3(5) | | | | |
| 5 | 0.05 | Zn based resin | 4.5 | 5.3 | 13.8(8) | 20(8) | | | | |
| 6 | 0.10 | Zn based resin | 3.0 | 4.7 | 6.5(2) | 9.8(2) | 11.8(5) | 17.3(5) | | |
| 7 | 0.15 | Zn based resin | 2.0 | 3.0 | 2.8(2) | 4.5(2) | 4.5(5) | 7.0(5) | 6.4(14) | 9.7(14) |
| 8 | 0.30 | Zn based resin | 1.1 | 1.3 | 1.3(2) | 1.5(2) | 1.3(5) | 1.5(5) | 1.5(21) | 2.0(21) |
| 9 | 0.00 | Zn based resin 0.0831% DPD added | 7.8 | 10.5 | 7.8(1) | 10.5(1) | 8.3(3) | 10.8(3) | 9.2(8) | 11.8(8) |

We claim:

1. A foundry mix comprising:

(A) a major amount of aggregate; and (B) an effective bonding amount of a binder system comprising as separate components:

(1) a phenolic resin component;

(a) a phenolic resin; and (b) an effective bench life extending amount of a nitrogen-containing aromatic compound selected from the group consisting of 2,2'-dipyridyl, 1,10-phenanthroline, and alkyl derivatives thereof; and (2) a polyisocyanate component.

2. The foundry mix of claim 1 wherein the binder composition is about 0.6 to 5.0 weight percent based upon the weight of the aggregate.

3. The foundry mix of claim 2 wherein the nitrogen-containing aromatic compound is soluble in the phenolic resin component.

4. The foundry mix of claim 3 wherein the phenolic resin component comprises a (a) a polybenzylic ether phenolic resin prepared by reacting an aldehyde with a phenol such that the molar ratio of aldehyde to phenol is from 1.1:1 to 3:1 in the presence of a divalent metal catalyst, and (b) a solvent in which the resole resin is soluble.

5. The foundry mix of claim 4 wherein the phenol is selected from the group consisting of phenol, o-cresol, p-cresol, and mixtures thereof.

6. The foundry mix claim 5 wherein the aldehyde is formaldehyde.

7. The foundry mix of claim 6 wherein the polynuclear aromatic compound is used in an amount of 0.01 to 3.0 weight percent based upon the weight of the total weight of components A and B.

8. The foundry mix of claim 7 wherein the ratio of hydroxyl groups of the polybenzylic ether phenolic resin to the isocyanate groups of the polyisocyanate hardener is from 0.90:1.1 to 1.1:0.90.

9. The foundry mix of claim 8 wherein the polyisocyanate component contains a compound selected from the group consisting of acid chlorides, acid anhydrides and mixtures thereof.

10. The foundry mix of claim 9 wherein the divalent metal catalyst used to prepare the phenolic resin is zinc.

11. A process for preparing a foundry shape by the cold-box process which comprises: –

(a) forming a foundry shape by introducing the foundry mix of claim 1 into a pattern;

(b) contacting the shaped foundry mix with a gaseous tertiary amine catalyst; and (c) removing the foundry shape of step (b) from the pattern.

12. The process of claim 11 wherein the amount of said binder composition is about 0.6 percent to about 5.0 percent based upon the weight of the aggregate.

13. The process of claim 11 wherein said foundry mix is the foundry mix of claim 3.

14. The process of claim 11 wherein said foundry mix is the foundry mix of claim 4.

15. The process of claim 11 wherein said foundry mix is the foundry mix of claim 5.

16. The process of claim 11 wherein said foundry mix is the foundry mix of claim 6.

17. The process of claim 11 wherein said foundry mix is the foundry mix of claim 7.

18. The process of claim 11 wherein said foundry mix is the foundry mix of claim 8.

19. The process of claim 11 wherein said foundry mix is the foundry mix of claim 9.

20. The process of claim 11 wherein said foundry mix is the foundry mix of claim 10.

* * * * *